US010190067B2

(12) United States Patent
Gunawidjaja et al.

(10) Patent No.: US 10,190,067 B2
(45) Date of Patent: Jan. 29, 2019

(54) HIGH PERFORMANCE ENVIRONMENTALLY ACCEPTABLE HYDRAULIC FLUID

(71) Applicant: Washington State University, Pullman, WA (US)

(72) Inventors: Ray Gunawidjaja, Spokane, WA (US); Pranav Nawani, Spokane, WA (US); Hergen Eilers, Spokane, WA (US)

(73) Assignee: Washington State University, Pullman, WA (US)

( * ) Notice: Subject to any disclaimer, the term of this patent is extended or adjusted under 35 U.S.C. 154(b) by 0 days.

(21) Appl. No.: 15/441,291

(22) Filed: Feb. 24, 2017

(65) Prior Publication Data

US 2017/0240833 A1 Aug. 24, 2017

Related U.S. Application Data

(60) Provisional application No. 62/299,159, filed on Feb. 24, 2016.

(51) Int. Cl.

| | |
|---|---|
| ***C10M 169/04*** | (2006.01) |
| ***C10M 105/36*** | (2006.01) |
| ***C10M 105/04*** | (2006.01) |
| ***C10M 107/34*** | (2006.01) |
| ***C10M 101/02*** | (2006.01) |

(Continued)

(52) U.S. Cl.

CPC ..... *C10M 105/36* (2013.01); *C10M 101/02* (2013.01); *C10M 101/04* (2013.01); *C10M 105/04* (2013.01); *C10M 105/38* (2013.01); *C10M 107/34* (2013.01); *C10M 169/04* (2013.01); *C10M 2203/024* (2013.01); *C10M 2205/0285* (2013.01); *C10M 2207/289* (2013.01); *C10M 2207/2825* (2013.01); *C10M 2207/401* (2013.01); *C10M 2209/103* (2013.01); *C10M 2209/1033* (2013.01); *C10M 2215/066* (2013.01); *C10N 2230/02* (2013.01); *C10N 2230/06* (2013.01); *C10N 2230/10* (2013.01); *C10N 2230/12* (2013.01); *C10N 2230/18* (2013.01); *C10N 2230/64* (2013.01); *C10N 2230/66* (2013.01); *C10N 2240/08* (2013.01)

(58) Field of Classification Search

CPC ..... C10N 2230/64
USPC ..... 508/579, 491
See application file for complete search history.

(56) References Cited

U.S. PATENT DOCUMENTS 5,972,855 A * 10/1999 Honary ..... C10M 101/04 252/73
6,340,658 B1 * 1/2002 Cannon ..... C10M 101/04 174/17 LF (Continued)

*Primary Examiner* — Ellen M McAvoy
(74) *Attorney, Agent, or Firm* — Whitham & Cook, P.C.

(57) ABSTRACT

A novel hydraulic (e.g., a biohydraulic) fluid which has high performance attributes is disclosed herein. Such a novel hydraulic fluid includes a contribution of a range of 10% up to about 85% by weight of at least one of: natural esters, synthetic esters, polyols, a vegetable oil, 1% up to about 40% by weight of polyalphaolefin (PAO), 1% up to about 40% by weight of polyalkylene glycol (PAG), and mixtures thereof, and wherein up to about 10% by weight quantity of one or more additives are introduced to provide desired properties that include at least one of: a high viscosity index, a low pour point, a hydrolytic stability, and an oxidative stability, as part of the hydraulic fluid contribution.

6 Claims, 5 Drawing Sheets

(51) Int. Cl.
*C10M 101/04* (2006.01)
*C10M 105/38* (2006.01)

(56) References Cited

U.S. PATENT DOCUMENTS

| | | | | |
|---|---|---|---|---|
| 6,383,992 | B1 * | 5/2002 | Garmier | C10M 169/04 508/491 |
| 7,741,259 | B2 * | 6/2010 | da Costa | C10M 107/34 508/110 |
| 7,781,384 | B2 * | 8/2010 | Kian | C10M 105/38 426/601 |
| 8,168,572 | B2 * | 5/2012 | Thoen | C10M 111/04 508/456 |
| 8,980,808 | B2 * | 3/2015 | Zehler | C10M 129/74 508/202 |
| 2005/0059562 | A1 * | 3/2005 | Garmier | C10M 111/02 508/437 |
| 2007/0197410 | A1 * | 8/2007 | Placek | C10M 145/14 508/469 |
| 2009/0176670 | A1 * | 7/2009 | Kawasaki | C10M 169/04 508/177 |
| 2010/0048931 | A1 * | 2/2010 | Westfechtel | C07C 69/58 554/223 |
| 2010/0120640 | A1 * | 5/2010 | Schwab | C10M 133/44 508/423 |
| 2010/0204075 | A1 * | 8/2010 | da Costa | C10M 107/34 508/579 |
| 2013/0190217 | A1 * | 7/2013 | Lammle | C10M 105/36 508/496 |
| 2017/0121630 | A1 * | 5/2017 | Vettel | C10M 169/04 |

* cited by examiner

HIGH PERFORMANCE ENVIRONMENTALLY ACCEPTABLE HYDRAULIC FLUID

This application claims priority to the U.S. Provisional Application No. 62/299,159 filed Feb. 24, 2016, the complete content of which are herein incorporated by reference.

BACKGROUND OF THE INVENTION

Field of the Invention

The present embodiments herein relate to the field of high-performance environmentally-acceptable hydraulic fluid blend containing fluids from up to four different classes of environmentally-acceptable hydraulic fluids, plus additives.

Discussion of the Related Art

The purpose of a lubricant is generally to minimize friction and wear of metals. Lubricants generally consist of a base fluid and additives selected to improve the lubricating properties or other properties of the lubricant (e.g., stability, performance at low or high temperature, etc.). With industrialization, mineral based lubricants became important in the market. Most existing heavy duty lubricating oils used for construction equipment and the like contain mineral oils as a main a component. For example, hydraulic systems found in farm tractors, backhoes, excavators, garbage trucks, snow plows and other heavy equipment generally use mineral oil based fluids as lubricants. Mineral oils have the advantages of lubricity, longevity, and corrosion resistance.

The drawbacks of mineral based lubricants are that they are toxic, they have long term residual properties making them difficult to dispose of safely (i.e., long term, they have very low biodegradability), and they are very difficult to clean if there is an accidental spill. In particular, they are environmentally unacceptable. Thus, unauthorized release and spill of mineral oil based lubricants can have significant adverse impacts on terrestrial and aquatic environments, as well as underground sources of drinking water. Furthermore, scattering and leakage of oil is generally difficult to avoid during usage; hence, mineral oil usage inevitably leads to at least some contamination of the environment. Spillage clean up can require removing the top layer of the grass or soil and containment for proper disposal which involves significant labor hours and additional costs.

Accordingly, because of the foregoing problems with respect to mineral-oil derived hydraulic fluids, there is a desire in the industry for Environmentally-Acceptable (EA) hydraulic and lubricating fluids to protect the environment but still offer beneficial lubricating properties. Generally, there are four basic types of environmentally friendly hydraulic and lubricating fluids that are commonly used individually. Each have different chemistries and each are derived from different stocks and thus have different applications and thus may necessitate a designed composition to address lubricating a material (e.g., seals) that it is to interact with during particular operations.

In particular, one of the four of such fluids is a hydraulic environmental ester synthetic (HEES) fluid, which is a water-insoluble synthetic ester derived from either petroleum, animal oils, or vegetable (typically rapeseed) oil feedstocks. Petroleum-sourced HEES fluids combine an organic acid and alcohol, whereas vegetable sourced fluids combine a fatty acid and alcohol. A second of such fluids includes hydraulic environmental triglyceride (HETG), which are water insoluble triglycerides derived from vegetable or animal oils with soybean, sunflower, and rapeseed (Canola) being the most common sources, wherein they often can contain soluble thickeners to increase viscosity. A third of such fluids includes hydraulic environmental poly glycols (HEPG), which are often but not necessarily water-soluble (e.g., oil-soluble) polyalkylene glycols (PAG), polymers made from reacting alkylene-oxide monomers such as ethylene oxide, propylene glycol, or propylene oxide with glycol. The fourth basic type of environmentally friendly hydraulic and lubricating fluid includes hydraulic environmental polyalphaolefin and related products (HEPR) fluids, which are water-insoluble polyalphaoletins (PAO) and related hydrocarbon-based fluids. Such synthetic hydrocarbons are made by polymerizing alpha olefins to produce PAO.

With respect to illustrative but not exhaustive example properties of such fluids, HEES fluids have a broad viscosity range and have high thermal and oxidative stability and good fluidity at low temperatures. However, they hydrolyze in the presence of water. HETG fluids are highly biodegradable and nontoxic and are noncorrosive. However, high-temperature operation can cause undesired fast oxidation and aging, extreme thickening and gumming, and they are vulnerable to water effects, causing hydrolysis and increased acidity. HEPG fluids have been found to be incompatible with polyurethane seals, and pumps and motors often utilized in systems requiring lubricants. HEPR fluids have outstanding oxidation stability, corrosion protection, beneficial lubricity, desired aging characteristics, and good viscosity performance over a wide temperature range. Nonetheless, much like HEPG fluids, they have been found to be incompatible with many seal and gasket materials.

It is to be noted however, that while each of the above four basic environmentally acceptable fluids have beneficial properties (in addition of course to deleterious properties), none of them can compete with unacceptable environmental (i.e., mineral based) fluids in all performance categories and thus when utilized, often require special system design and maintenance considerations.

Accordingly, there is a need to provide environmentally-acceptable hydraulic fluid blends that addresses environmental and system performance/cost concerns. The embodiments herein address such a need by providing a novel high-performance environmentally-acceptable hydraulic fluid blend containing fluids from up to four of the different classes of environmentally-acceptable hydraulic fluids discussed above, plus additives. By selecting relative concentrations of such Environmentally-Acceptable (EA) fluids in a novel fashion, resultant desired performance properties acting in a synergistic way are optimized, making them competitive with non-Environmentally-Acceptable (EA) fluids.

SUMMARY OF THE INVENTION

It is to be appreciated that the present example embodiments herein are directed to high performance environmentally acceptable fluid (e.g., a biodegradable hydraulic fluid) that can include synthetic oils, and optionally stable vegetable and animal oils (unsaturated), and additives. The synthetic oil often but not necessarily includes trimethylolpropane trioleate (TMPTO) esters of predominantly mono unsaturated vegetable oils. By "predominantly mono unsaturated", it should be understood that at least 50% of the fatty acid moieties are mono unsaturated fatty acids. The synthetic oil may also be formed from vegetable oils or vegetable oil blends or animal oils or animal oil blends, which have low levels of saturated fatty acids (i.e., no carbon carbon double bonds) and/or low levels of polyunsaturated fatty acids (i.e., two or more carbon carbon double bonds).

The present embodiments are thus directed to a hydraulic fluid that includes a contribution of a range of 10% up to about 85% by weight of at least one of: natural esters, synthetic esters, polyols, a vegetable oil, 1% up to about 40% by weight of polyalphaolefin (PAO), 1% up to about 40% by weight of polyalkylene glycol (PAG), and mixtures thereof; and wherein up to about 10% by weight quantity of one or more additives are introduced to provide desired properties that include at least one of: a high viscosity index, a low pour point, a hydrolytic stability, and an oxidative stability, as part of the hydraulic fluid contribution.

Accordingly, the fluid blends disclosed herein thus exhibit the following beneficial properties:

- Outstanding oxidative and hydrolytic stability (the ability of a lubricant and its additives to resist chemical decomposition in the presence of oxygen and water).
- Environmentally acceptable-all base fluids used non-toxic and biodegradable components.
- Low pour point, wherein pour point is the temperature at which it becomes semi-solid and loses its flow characteristics.
- High viscosity index, wherein viscosity index is the measure for the change of viscosity with variations in temperature.

DETAILED DESCRIPTION

Figure 1A:
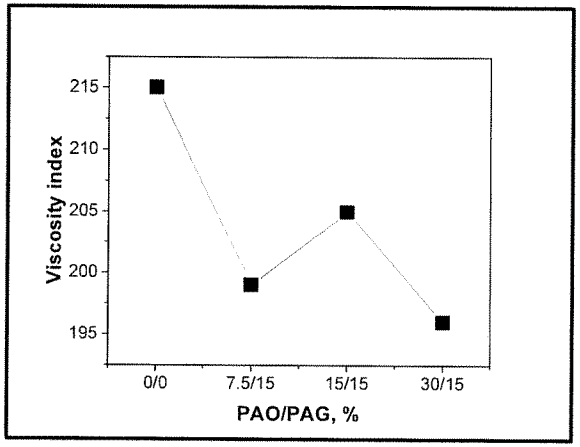
FIG. 1A shows a plot of viscosity index versus PAO/PAG ratio indicating that the viscosity index is worst when the amount of PAO is greater than the amount of PAG.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. It is to be noted that as used herein, the term "adjacent" does not require immediate adjacency. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise. In addition, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

Specific Description

The embodiments herein are directed to a hydraulic fluid formulation and method for its production. In particular, the embodiments herein are directed to a new class of high-performance environmentally acceptable hydraulic fluids. According to IS015380, environmentally acceptable hydraulic fluids can be divided into four categories: (1) Hydraulic Environmental Synthetic Esters (HEES), which include for example trimethylolpropane triesters (TMPTEs) which may or may not be genetically or synthetically modified, polyols wherein the polyols with varying numbers and fatty acids chain lengths such as neopentyl glycol dioleate (diester), trimethylolpropane trioleate (TMPTO) (triester), pentaerythritol tetraoleate (tetraester) from vegetable oils or animal oils; (2) Hydraulic Environmental Tri-Glycerides (HETG), which include for example vegetable oils and animal oils; (3) Hydraulic Environmental Polyalphaolefins and Related products (HEPR); and (4) Hydraulic Environmental Poly-Glycols (HEPG). It is also to be noted that as used herein, natural oils include both vegetable and animal based oil that are genetically or synthetically modified but that nonetheless can exclude synthetic or genetic modification.

Fluids from each of these four categories offer a certain set of properties, as briefly discussed above, that are not necessarily exhibited by fluids from other categories. For instance in addition to what was previously discussed, fluids in the HETG category have a high viscosity index and are readily biodegradable, but have a high pour point and are prone to hydrolysis and oxidation. Fluids in the HEES category are more hydrolytically and oxidatively stable than fluids in the HETG category, but they tend to have a lower viscosity index. Fluids in the HEPR category are oxidatively stable and have a low pour point, while fluids in the HEPG category are hydrolytically stable. Fluids in the HETG and HEES categories are derived from renewable resources, whereas fluids in the HEPR and HEPG categories are derived from non-renewable resources (petroleum).

Hydraulic fluids derived from vegetable oils and animals oils belong to the HETG category. These fluids are appealing due to their biodegradability, low ecotoxicity, and are derived from renewable resources. Triglycerides display good hydraulic fluid properties, but they are prone to hydrolysis, have a poor oxidative stability, and a poor low-temperature performance. To improve the properties of triglycerides, the glycerol backbone can be replaced by other polyols to yield synthetic esters (HEES). One example of such fluids is trimethylolpropane triester (TMPTE), which displays improved hydrolytic stability and low-temperature performance. High-oleic HETG and HEES fluids are known to exhibit improved pour point, and hydrolytic and oxidative stability. The properties of HETG and HEES ester fluids can be further improved by adding polyalphaolefin (PAO), a HEPR fluid, which is known to enhance oxidative stability. Addition of polyalkylene glycol (PAG), a HEPG fluid, is known to improve hydrolytic stability.

Fluid Development

Optimum combination of properties (including a high viscosity index, a low pour point, a high oxidative stability, and a high hydrolytic stability) are determined by blending fluids from up to four categories. Other inadequate properties are compensated for by using chemical additives. The main component of the blend often includes ester base fluids, while PAO and PAG are diluents.

As part of this determination, a three part study provided for improving the oxidative stability of the hydraulic fluid blend. Part I and part II in particular was directed to improving the oxidative stability of the hydraulic fluid blend, which is mainly composed of TMPTO base fluid, while in part III, the role of PAG on improving the hydrolytic stability is assessed. The following are brief non-limiting descriptions of the three part study.

Part I: Optimization of Oxidative Stability

Parameters include: High-oleic vegetable oil (soybean vs. canola); Influence of PAO; and Influence of different antioxidants (F323/57 (Functional Products, Inc.), NA-L (King Industries, Inc.), and VAN (Vanderbilt Chemicals, LLC.)). It was determined that the addition of PAO desirably lowers the pour point and improves the oxidative stability. The formulation containing NA-Lube BL-1208 (NA-L) shows the highest oxidative stability. Furthermore, the formulation with the optimum combined properties contains high oleic canola oil derived TMPTO base fluid. Therefore, all subsequent formulations contain PAO, NA-L, and high oleic canola oil based TMPTO. From here onwards, TMPTO refers to high oleic canola oil derived trimethylolpropane trioleate base fluid.

Part II: Optimization of Oxidative Stability

Parameters include: Influence of PAO in combination with PAG. To further improve the oxidative stability, another non-ester type fluid, PAG, is incorporated. The percentage of the non-ester type fluids is varied and the results are compared with those of the TMPTO base fluid (synthetic ester) and our vegetable oil base fluid (natural ester).

The role of PAO as an oxidative stability improver was confirmed, and we obtained hydraulic fluid formulations showing comparable or higher oxidative stability performance than Bio-Ultimax™ 1000. PAG is also found to improve the oxidative stability, but not as much as PAO.

Part III: Optimization of Oxidative and Hydraulic Stability (Parameters Include: Vegetable Oil (VO), PAO, and PAG.

While the effect of PAG on improving the oxidative stability of ester base fluids is smaller than that of PAO, PAG beneficially can improve hydrolytic stability. This aspect is especially important, since ester base fluids are known to degrade via hydrolysis to give acid in the presence of water. As an example but a non-limiting blend, a vegetable oil/PAG blend is available commercially as Dow Symbio™ (Dow Chemical Co.). Accordingly, the role of PAG was confirmed as a hydrolytic stability improver and a fluid formulation with a high viscosity index, a low pour point, and a good hydrolytic and high oxidative stability is obtained.

Table 1.1 shown below summarizes the role of each base fluid component when added to TMPTO as determined from the experiments performed in parts I, II, and III. The comparison of the antioxidants shows that NA-L results in the best oxidative stability improvement for the ester base fluids (TMPTO or VO). The concentration of the pour point depressant (Viscoplex 10-171) and the antifoam additive (Viscoplex 14-520) are fixed throughout the study. It is seen that each of these components contribute to the overall property of the fluid. It is to be noted that while both PAG and PAO contribute to oxidative stability, the oxidative stability improvement due to PAG is not as significant as that due to PAO.

TABLE 1.1

Role of each base fluid on the overall fluid's performance with TMPTO being the major component.

| Component | Viscosity index | Pour point | Oxidative stability | Hydrolytic stability |
|---|---|---|---|---|
| VO | + | − | − | − |
| PAO | − | + | + | − |
| PAG | − | − | + | + |

'+' means positive and '−' means negative effect.

Table 1.2 shown below compares selected properties of various fluid blends and compares them with those of a commercially available fluid, i.e., Bio-Ultimax™ 1000.

TABLE 1.2

Table 1.2. Comparison of selected properties of ASL 1 through ASL 5, and BioUltimax ™ 1000 fluids. Except for ASL 2b and Bio-Ultimax ™ 1000, the main base fluid is TMPTO.

| Properties | ASL 1 | ASL 2a | ASL 2b | ASL 3 | ASL 4 | ASL 5 | Bio-Ultimax ™ 1000, ISO32 |
|---|---|---|---|---|---|---|---|
| Viscosity index | 180 | 202 | 192 | 198 | 205 | 196 | 197 |
| Pour point/ ° C. | −51 | −39 | −33 | −51 | −45 | −48 | −36 |
| RPVOT*/ min | 279 | 303 | 320 | 327 | 302 | 383 | 272 |
| Cu corrosion | 1b | 1b | N/A | 1b | 1b | 1b | N/A |

*RPVOT = Rotating Pressure Vessel Oxidation Test, which is a measure of oxidative stability.

Additional formulations of environmentally acceptable hydraulic fluids can be prepared using various grades of esters derived from animal-based oils or plant-based oils. Also various grades of PAO, PAG, antioxidants and other additives can be used. Example additives include N,N' di sec butyl p-phenylenediamine, Vanlube NA, Vanlube 81, Vanlube 961, Vanlube SS, NA Lube AO-142, NA Lube AO-242, Naugalube 640, Naugalube 438 L, Naugalube TMQ, BHA, TBHQ, BHT, Ethanox 470, Ethanox 4716, NA Lube AO-210, Lauryl Gallate, and Propyl Gallate. Different viscosity grades of environmentally acceptable hydraulic oil blends also can be developed with the aid of commercially available viscosity improver additives and/or by varying the concentration of individual components in the final blend. Moreover, the properties shown above are non-limiting examples of the beneficial properties of the hydraulic fluids disclosed herein. For example, the pour point temperature can vary down to −55° C. and up to about −30° C. for particular compositions.

Example but desired recipes within the practice of the invention is set forth as shown in Table 1.3 below:

TABLE 1.3

Table 1.3. Formulations [%] of hydraulic fluid blends.

| Sample | TMPTO | VO | PAO | PAG | NA-L | V 10-171 | V 14-520 |
|---|---|---|---|---|---|---|---|
| ASL 1 | 81.9 | 0 | 15 | 0 | 2 | 1 | 0.1 |
| ASL 2a | 66.9 | 0 | 15 | 15 | 2 | 1 | 0.1 |
| ASL 2b | 0 | 66.9 | 15 | 15 | 2 | 1 | 0.1 |
| ASL 3 | 66.9 | 0 | 30 | 0 | 2 | 1 | 0.1 |
| ASL 4 | 51.9 | 15 | 15 | 15 | 2 | 1 | 0.1 |
| ASL 5 | 51.9 | 0 | 30 | 15 | 2 | 1 | 0.1 |

Accordingly, in a novel but non-limiting fashion, Table 1.2 clearly demonstrates beneficial unlimiting example compositions (e.g., example nomenclature ASL 1) that demonstrate the workings of the inventions disclosed herein. In particular, Part 1 of the study yielded ASL 1, which exhibits a high viscosity index, a low pour point, and a high oxidative stability. Part II of the study yielded ASL 2a, ASL 2b, and ASL 3. ASL 2a shows a lower pour point than ASL 2b, but a slightly lower RPVOT value. The difference in RPVOT, however, is only about 5%. ASL 3 shows better combined properties than ASL 1, ASL 2a, and ASL 2b. Part III of the study yielded ASL 4 and ASL 5, which pass the hydrolytic stability test with a copper appearance of 1b. ASL 4 shows properties that are on par with those of ASL 2a, ASL 2b, and ASL 3. ASL 5 shows a significantly higher oxidative stability than all other ASL formulations, a high viscosity index, and a low pour point. It is also to be appreciated that although particular percentages are shown for the example compositions in Table 1.3, such percentages can vary in providing for the non-limiting example compositions, as disclosed herein. As an illustration, trimethylolpropane trioleate (TMPTO), ASL1 shown by example only in Table 1.3, can be as high as up to about 85% by weight or down to about 40% by weight in the example compositions disclosed herein when desired. Even more particular, from 10% up to about 40% by weight of polyalphaolefin (PAO), and up to about 20% by weight of polyalkylene glycol (PAG) can also be beneficial configurations. Moreover, a vegetable oil contribution in a range of up to about 70% by weight can be mixed in the hydraulic fluid.

Comparing the performance properties of fluids ASL 1 through ASL 5 with those of Bio-Ultimax™: 1) The viscosity indices are comparable with one another, 2) The pour points are comparable or better than that of BioUltimax™. When measured by the same vendor (Petrolube), the RPVOT numbers are at least comparable or significantly better (up to 41% for ASL 5) to that of Bio-Ultimax™.

Effect of PAO and PAG on TMPTO Fluid

1. Optimizing the Synergistic Effect of PAO and PAG

PAO and PAG play different roles in enhancing the properties of TMPTO fluid. PAO significantly increases the oxidative stability and maintains a low pour point, but it has an adverse effect on hydrolytic stability. PAG improves the hydrolytic stability and slightly increases the oxidative stability, but undesirably increases the pour point, as discussed in detail below. It is also to be noted that when used together, both PAO and PAG can compensate for each other's inadequate properties.

A composition to optimize PAO and PAG contribution to the property of the TMPTO fluid, asymmetric PAO/PAG ratios was assessed, wherein the amount of PAG is fixed. As an example TMPTO fluid formulation, such a fluid formulation contains antioxidant (NA-Lube BL-1208), 2 wt %, pour point depressant (Viscoplex 10-171), 1 wt %, and antifoam additive (Viscoplex 14-520), 0.1 wt %.

Figure 1B:
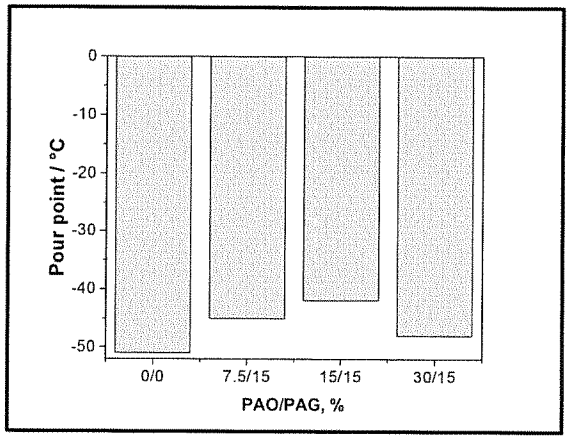
FIG. 1B shows a plot of Pour point/° C. versus PAO/PAG ratio indicating that the pour point is undesirably highest at equal amounts of PAO and PAG.
Figure 1C:
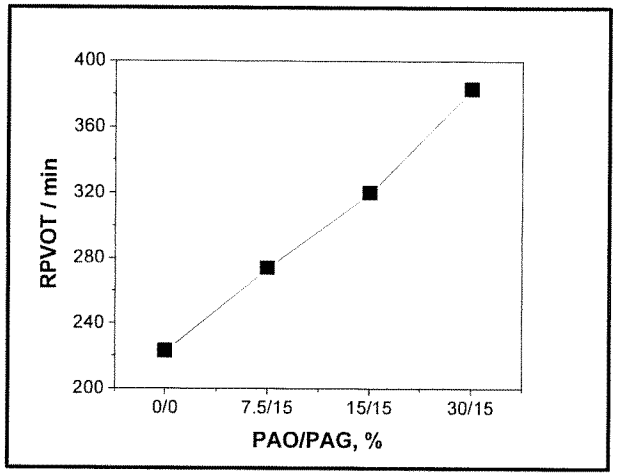
FIG. 1C shows a plot of Rotating Pressure Vessel Oxidation Test (RPVOT) versus PAO/PAG, ratio indicating that the oxidative stability increases linearly with increasing amounts of PAO.

FIG. 1A, FIG. 1B and FIG. 1C shows the effects of PAO/PAG ratios. In particular, FIG. 1A shows that the reduction in the viscosity index is worst when the amount of PAO is greater than the amount of PAG. FIG. 1B indicates that the pour point is undesirably highest at equal amount of PAO and PAG and FIG. 1C shows the oxidative stability (measured as Rotating Pressure Vessel Oxidation Test (RPVOT) value) increasing linearly with increasing amount of PAO.

Overall, PAO/PAG ratios between 0.2 and 5 are expected to demonstrate desired properties with the 30/15 of PAO/

PAG composition showing the best combined properties with a relatively low pour point and highest oxidative stability. The viscosity index is lowest, but differs only by 8.8% from the TMPTO fluid. The RPVOT value of the fluid containing 30/15 of PAO/PAG is significantly higher than the TMPTO fluid by 71.7%.

Figure 2A:
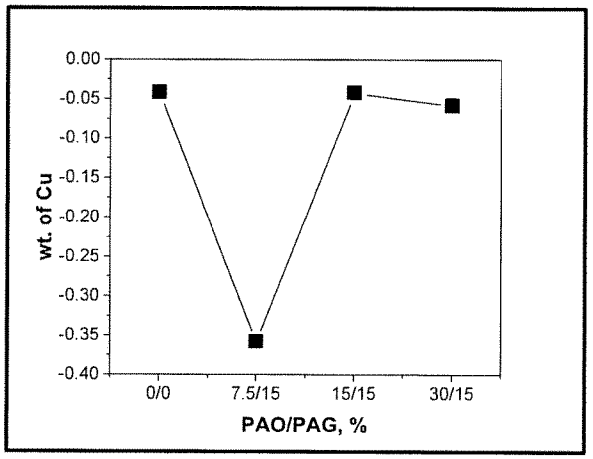
FIG. 2A shows a plot of weight of copper (Cu) versus PAO/PAG ratio.
Figure 2B:
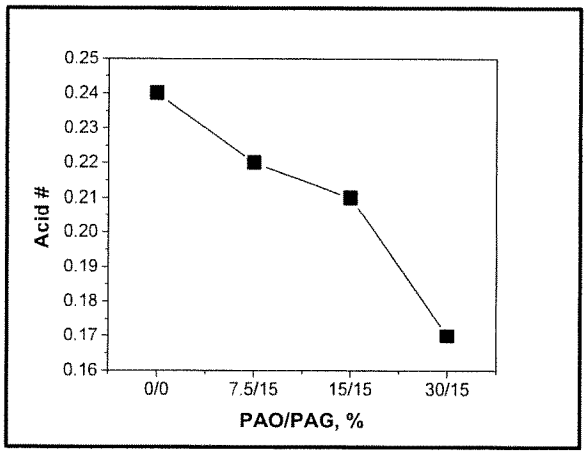
FIG. 2B shows a plot of Acid # versus PAO/PAG ratio indicating that the change in the acid # is lowest at the 30/15 PAO/PAG ratio, as shown in FIG. 2A.
Figure 2C:
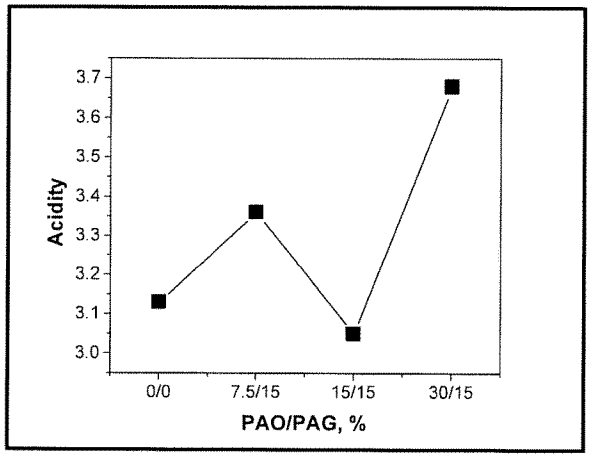
FIG. 2C shows a plot of Acidity versus PAO/PAG, ratio indicating that at the 30/15 of PAO/PAG ratio, although the change in acidity is highest, the weight of copper is on par with 0/0 of PAO/PAG ratio, as shown in FIG. 2A.
Figure 2D:
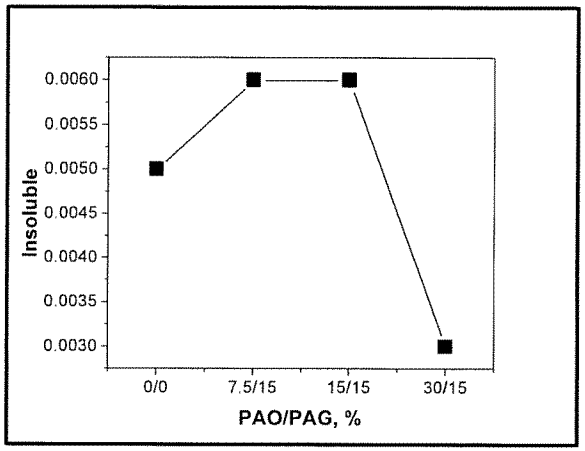
FIG. 2D shows a plot of insoluble versus PAO/PAG ratio indicating the amount of insoluble is lowest at the 30/15 PAO/PAG ratio, as shown in FIG. 2A.

FIG. 2A-FIG. 2D show that at the optimum 30/15 of PAO/PAG ratio, although the change in acidity is highest (FIG. 2C), the weight of copper is on par with 0/0 of PAO/PAG ratio (FIG. 2A), the change in the acid number is lowest (FIG. 2B), and the amount of insoluble is lowest (FIG. 2D).

Figure 3A:
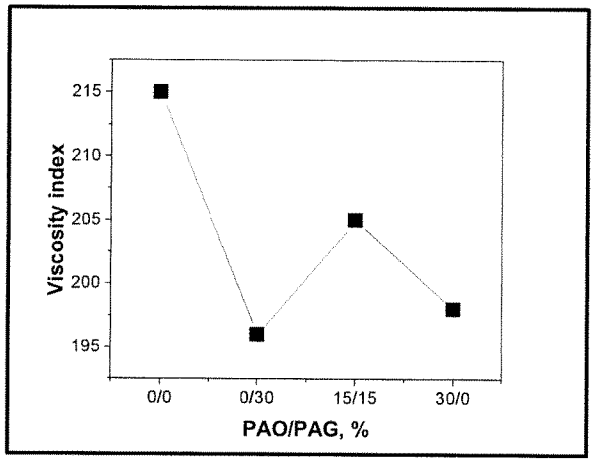
FIG. 3A shows a plot of viscosity index versus PAO/PAG ratio indicating the effect of adding PAO and PAG to a TMPTO fluid formulation on its viscosity index, pour point, and RPVOT value.

2. Effect of PAO and PAG on Viscosity Index, Pour Point, Oxidative Stability, and Hydrolytic Stability of TMPTO Fluid Effect of PAO and PAG on Viscosity Index, Pour Point, and Oxidative Stability FIG. 3A shows the effect of adding PAO and PAG to a TMPTO fluid formulation on its viscosity index, pour point, and RPVOT value. The total amount of PAO, PAG, and PAO/PAG diluents are fixed at 30 wt %. The TMPTO fluid formulation contains antioxidant (NA-Lube BL-1208), 2 wt %, pour point depressant (Viscoplex 10-171), 1 wt %, and antifoam additive (Viscoplex 14-520), 0.1 wt %.

The TMPTO base fluid is known to exhibit higher viscosity index than PAO and PAG. Reduction in the viscosity index due to addition of PAO and PAG is therefore expected. However, FIG. 3A shows that the reduction in the viscosity index is diminished when both PAO and PAG are added simultaneously.

Figure 3B:
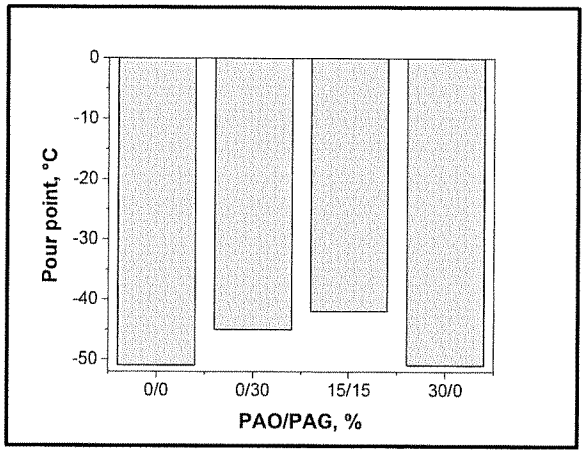
FIG. 3B shows a plot of Pour point/° C. versus PAO/PAG ratio indicating that in the absence of PAO and PAG, the pour point of the TMPTO fluid is lowest, the addition of PAO does not affect the pour point but the addition of PAG increases the pour points and simultaneous addition of PAO and PAG undesirably results in highest pour point.

FIG. 3B shows that in the absence of PAO and PAG, the pour point of the TMPTO fluid is lowest. Addition of PAO does not affect the pour point. But, addition of PAG increases the pour points. Simultaneous addition of PAO and PAG undesirably results in highest pour point.

Figure 3C:
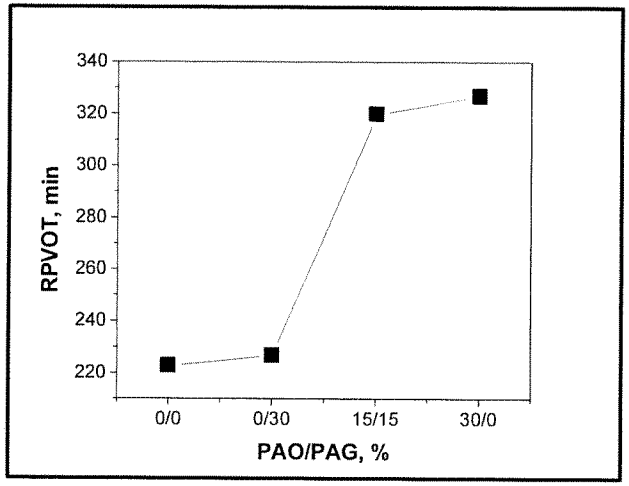
FIG. 3C shows that the RPVOT value is lowest when PAO and PAG are absent.

FIG. 3C shows that the RPVOT value is lowest when PAO and PAG are absent. Solely adding PAO results in the most significant increase in RPVOT value. Solely adding PAG improves the RPVOT value only slightly, but the increase in the RPVOT value becomes at par with solely adding PAO when PAO and PAG are added simultaneously.

Effect of PAO and PAG on Hydrolytic Stability of TMPTO Fluid

While PAG has adverse effects on pour point and viscosity index, the main function of PAG is to improve the hydrolytic stability of ester base fluids (i.e., TMPTO fluid). In order to determine the effect of PAO and PAG on the hydrolytic stability of TMPTO fluid, the different fluid formulations were tested according to the beverage bottle method (ASTM D2619). The post-test change in the acidity, weight of copper, acid number, amount of insoluble, viscosity (%) copper, and copper appearance are noted. The copper appearance are the same for all fluid compositions, 1b (as per ASTM D 130) and the % change in viscosity are all less than 1.0%.

Figure 4A:
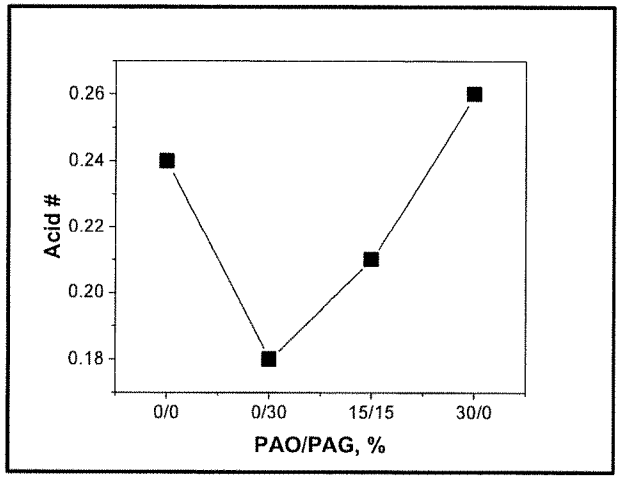
FIG. 4A illustrates a plot showing a change in hydraulic fluid properties as a function of PAO/PAG ratio.
Figure 4B:
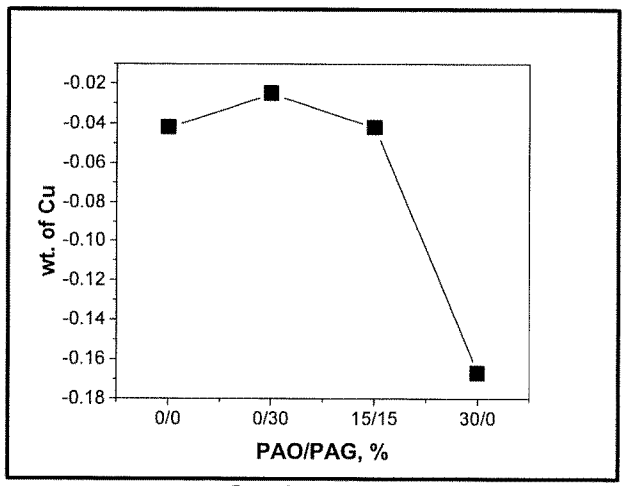
FIG. 4B illustrates a second plot showing a change in hydraulic fluid properties as a function of PAO/PAG ratio.
Figure 4C:
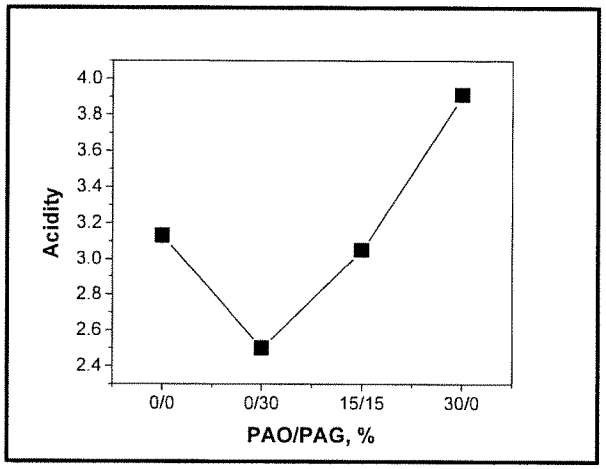
FIG. 4C illustrates a third plot showing a change in hydraulic fluid properties as a function of PAO/PAG ratio.
Figure 4D:
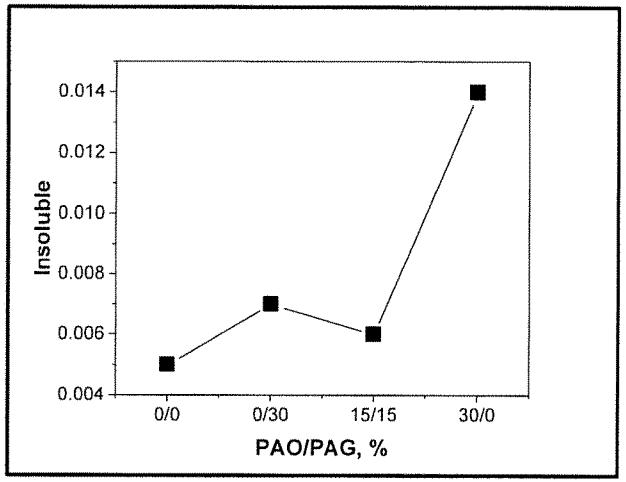
FIG. 4D shows a plot of insoluble versus PAO/PAG ratio.

FIG. 4A, FIG. 4B, FIG. 4C, and FIG. 4D show a change in hydraulic fluid properties as a function of PAO/PAG, %. In particular, FIG. 4A shows that adding PAO results in the highest reduction in the copper weight. FIG. 4B shows that adding PAO results in the highest increase in the acid number. FIG. 4C shows that adding PAO results in the highest increase in acidity, and FIG. 4D shows that adding PAO results in the highest increase in the amount of insoluble. It is to be noted however, that when PAO and PAG are present and when PAG is present in the fluid the following was also observed, as shown in FIG. 4A, FIG. 4B, FIG. 4C, and FIG. 4D. Specifically, FIG. 4A shows the change in the weight of copper are maintained. FIG. 4B shows that the change in the acid number are reduced. FIG. 2C shows that the change in acidity are reduced, and FIG. 4D shows Insoluble in accordance with the Standard Test Method for Hydrolytic Stability of Hydraulic Fluids (Beverage Bottle Method), (ASTM D2619). That is, simultaneous addition of PAO and PAG alleviates the adverse effect of PAO on hydrolytic stability.

Synergistic Effect of PAO and PAG

Figure 5A:
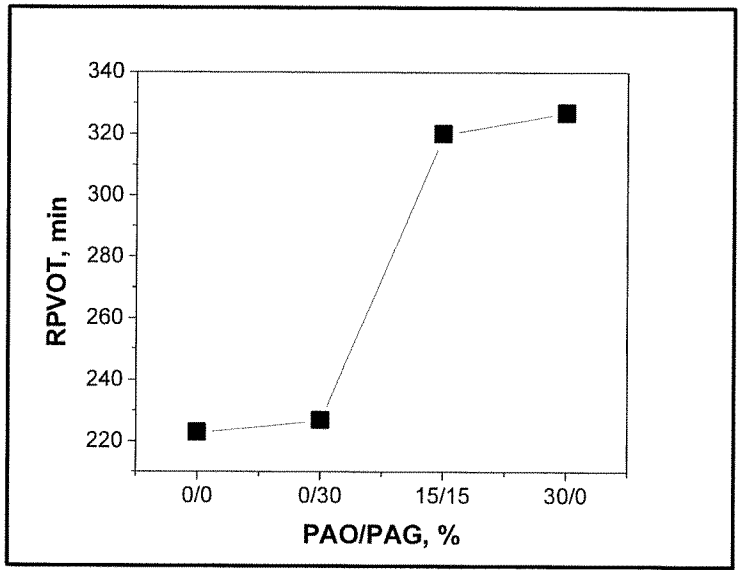
FIG. 5A shows a plot of RPVOT versus PAO/PAG ratio illustrating the effect of adding PAO and PAG on RPVOT values of TMPTO fluid for symmetric PAO/PAG ratios.
Figure 5B:
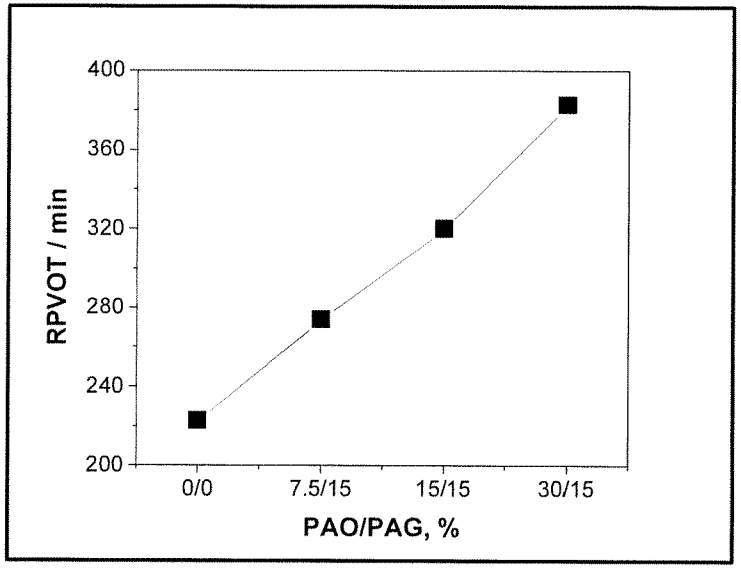
FIG. 5B shows a plot of RPVOT versus PAO/PAG ratio illustrating the effect of adding PAO and PAG on RPVOT values of TMPTO fluid for varying amounts of PAO, but a fixed amount of PAG.

FIG. 5A shows that solely adding PAG to a TMPTO fluid containing a fixed amount of antioxidant (NA-Lube BL-1208). 2 wt %, pour point depressant (Viscoplex 10-171), 1 wt %, and antifoam additive (Viscoplex 14-520), 0.1 wt %, increases the RPVOT value only slightly, by 1.8%. Solely adding PAO increases the oxidative stability significantly, by 46.6%. The increase in the RPVOT value when PAO and PAG are simultaneously added is at par with solely adding PAO, by 43.5%. FIG. 5B illustrates that for a fixed amount of PAG, increasing the amount of PAO increases the RPVOT value linearly.

It is to be appreciated that the fluids belonging to such different categories are characterized by certain properties. For example, fluids in the HEES and HETG categories are more biodegradable than fluids in the HEPR and HEPG categories. However, fluids in the HEPG category are characterized by a higher hydrolytic stability, and fluids in the HEPR category are characterized by a higher oxidative stability. The novel class of high-performance environmentally acceptable hydraulic fluids disclosed herein combines components from two or more of these categories in such a manner that the overall properties of the fluid such as a high viscosity index, low pour point, good hydrolytic stability, and good oxidative stability are derived from a synergistic interaction between the individual components. As examples of such fluids, the embodiments herein include evaluated properties of fluid blends containing the following major components: Trimethylolpropane trioleate (TMPTO) derived from canola oil (HEES). Vegetable oil (VO), (canola oil), obtained from Cargill, Inc. (HETG). Polyalphaolefin (PAO), (SPECTRASYN) obtained from Exxon Mobil Corp. (HEPR) Polyalkylene glycol (PAG), (UCON-OSP) obtained from Dow Chemical Co. (HEPG). In addition, various additives (e.g., NA-L, V 10-171, V 14-520) are used in desired quantities to further enhance or modify certain properties.

The invention is directed to a hydraulic fluid formulation and method for its production. The hydraulic fluids herein use natural or synthetic esters derived from vegetable or animal oils, or mixtures of the same, which are preferably highly unsaturated. Natural vegetable oils are glyceride esters, i.e., tri-, di- or monoesters of glycerol and straight chain saturated and unsaturated fatty acids. Exemplary vegetable oils which may be suitable for use in the formulation include rapeseed, rape, soybean, castor, olive, coconut; palm, tall, maize, walnut, flaxseed, and cotton, sunflower, safflower, sesame, almond, and canola oil. Desired base oils used in the invention include mixtures of oils obtained from chemical products producers such as Cargill. The vegetable oils and/or animal oils used in the practice of this invention will be predominantly monosaturated (i.e., they have only one carbon-carbon double bond in the fatty acid moiety); however, in some formulations, low levels of polyunsaturated vegetable oil may be employed.

Various additives can be added to the final mixture to comply with state and federal laws or to adjust the properties of the biohydraulic fluid include antioxidants, antiwear agents (e.g., zinc dithiophosphates, etc.), corrosion inhibitors, pour point depressants, and antifoam agents.

Antioxidants inhibit the oxidation of hydraulic oils by scavenging free radicals. Vegetable and animal oil based hydraulic fluids often contain substantial amounts of polyunsaturated oils to lower the pour point, and these oils are highly reactive with free radicals. When free radical react with polyunsaturated oils, cross linking or polymerization can occur, which increases viscosity. In extreme cases a rubbery residue is formed. Thus, because antioxidant additives have synergistic effects when mixed together, the embodiments herein can provide synergistic improvement.

Moreover, pour point additives can be beneficial utilized with the hydraulic liquids disclosed herein. Such polymer additives co-crystallize with the saturated oils, thereby dispersing them as particles small enough to avoid gelling. The co-crystallization process is sensitive to the chemical structures of the fluid and additive.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention.

We claim:

1. A hydraulic fluid, comprising:

one or more of a hydraulic environmental ester synthetic (HEES) and a hydraulic environmental triglyceride (HETG) at 10% to 85% by weight of the hydraulic fluid, wherein the one or more of HEES and HETG are or include natural and/or synthetic esters of at least one of vegetable-based and animal-based oils which are oleates;

a polyalphaolefin (PAO) at 1% to 40% by weight of the hydraulic fluid;

a polyalkylene glycol (PAG) at 1% to 40% by weight of the hydraulic fluid, wherein a ratio of PAO/PAG ranges from 0.2 to 5.

2. The hydraulic fluid of claim 1, wherein the one or more of HEES and HETG are or include esters selected from the group consisting of neopentyl glycol dioleate (diester), trimethylolpropane trioleate (TMPTO) (triester), and pentaerythritol tetraoleate (tetraester).

3. The hydraulic fluid of claim 1, further comprising one or more additives selected from the group consisting of antioxidants, antiwear agents, corrosion inhibitors, pour point depressants, viscosity modifiers, hydrolytic stabilizers, and antifoam agents.

4. The hydraulic fluid of claim 3, wherein the one or more additives include or consist of pour point depressant additives.

5. The hydraulic fluid of claim 3, wherein the one or more additives include or consist of antioxidant additives.

6. The hydraulic fluid of claim 1, wherein the PAO/PAG ratio is 30/15.

* * * * *